US008050436B2

(12) United States Patent
Kasanmascheff

(10) Patent No.: US 8,050,436 B2
(45) Date of Patent: Nov. 1, 2011

(54) METHOD FOR AMPLIFYING AN ACOUSTIC SIGNAL AND CORRESPONDING ACOUSTIC SYSTEM

(75) Inventor: Robert Kasanmascheff, Höchstadt (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1360 days.

(21) Appl. No.: 11/263,342

(22) Filed: Oct. 31, 2005

(65) Prior Publication Data

US 2006/0098832 A1 May 11, 2006

(30) Foreign Application Priority Data

Nov. 8, 2004 (DE) ..... 10 2004 053 776

(51) Int. Cl.
*H04R 25/00* (2006.01)

(52) U.S. Cl. ..... 381/321; 381/316; 381/317; 381/318; 381/94.4

(58) Field of Classification Search ..... 381/317, 381/318, 321, 316, 94.1
See application file for complete search history.

(56) References Cited

U.S. PATENT DOCUMENTS

| | | | | |
|---|---|---|---|---|
| 4,689,820 | A * | 8/1987 | Kopke et al. | 381/315 |
| 6,115,478 | A * | 9/2000 | Schneider | 381/314 |
| 7,386,142 | B2 * | 6/2008 | Kindred | 381/318 |
| 7,430,299 | B2 * | 9/2008 | Armstrong et al. | 381/312 |
| 7,519,193 | B2 * | 4/2009 | Fretz | 381/312 |
| 7,609,841 | B2 * | 10/2009 | Freed et al. | 381/318 |
| 2002/0094100 | A1 * | 7/2002 | Kates et al. | 381/318 |
| 2003/0002699 | A1 | 1/2003 | Schulz et al. | |
| 2008/0063230 | A1 * | 3/2008 | Gao et al. | 381/318 |

FOREIGN PATENT DOCUMENTS

| | | |
|---|---|---|
| DE | 101 31 964 A1 | 1/2003 |
| DE | 101 59 928 A1 | 5/2003 |

* cited by examiner

*Primary Examiner* — Davetta W Goins
*Assistant Examiner* — Jasmine Pritchard

(57) ABSTRACT

In acoustic systems, especially with hearing aids, feedback whistling keeps occurring. To avoid this, a limit gain frequency response of the amplification device, which represents the limits of feedback whistling, is thus recorded. On the basis of the curve recorded a required gain frequency response with a number of interpolation points is created, with each interpolation point having a predetermined minimum distance in each case to the limit gain frequency response in at least two different directions. This enables feedback whistling to be largely avoided, even with shifts in resonant frequencies.

12 Claims, 6 Drawing Sheets

METHOD FOR AMPLIFYING AN ACOUSTIC SIGNAL AND CORRESPONDING ACOUSTIC SYSTEM

CROSS REFERENCE TO RELATED APPLICATIONS

This application claims priority to the German application No. 10 2004 053 776.3, filed Nov. 8, 2004 which is incorporated by reference herein in its entirety.

FIELD OF INVENTION

The present invention relates to a method for amplifying an acoustic signal, especially for a hearing aid, by receiving a limit gain-frequency response curve of the amplification device which represents the limit for feedback whistling and providing a target gain-frequency response curve. In addition the present invention relates to a corresponding acoustic system.

BACKGROUND OF INVENTION

To adapt a hearing aid to hearing loss, required gain curves are calculated on the basis of the measured hearing loss. These prescribe the corresponding gain values for generally three input levels in the frequency range. The ambient conditions when wearing a hearing aid make it possible for the amplified signals output by the hearing aid speaker to be picked up again by the hearing aid microphone. This is especially the case for open supply and with gaps in the seal in the case of closed supply. If the feedback loop is not attenuated, whistling occurs.

The feedback whistling not only disturbs the wearer of the hearing aid but also other people in his or her immediate environment. To avoid the whistling, the nominal gain curve is usually reduced somewhat. To this end the gain curve of the feedback loop is measured according to its separation at a point and, for each frequency, that gain which represents the limit for feedback or feedback whistling is determined. To prevent whistling the values must always be below this limit gain. Since feedback paths are only static under some conditions and thus the limit gain can be temporally exceeded, the gain is generally reduced to the point at which there is always a minimum distance to be measured from the limit gain curve.

The prior art described in the two paragraphs above can for example be found in publication DE 101 31 964 A1. To avoid whistling the publication recommends a method for operating a hearing aid in which a gain reduction is undertaken as soon as an interference noise is recognized as such.

In publication DE 101 59 928 A1 a method for avoiding feedback-related oscillations in a hearing aid is described. When feedback-related oscillations are detected, the gain is reduced in an area of low signal level of the input signal and, in an area of high signal level of the input signal, the gain is reduced less or is not reduced.

Despite reduction in the required gain curve as known in the art, feedback whistling can still occur, especially in the area of resonances, since for example the resonant frequencies can change dynamically depending on the ambient conditions.

SUMMARY OF THE INVENTION

An object of the present invention is to provide a method in which feedback whistling can be more securely prevented. In addition a corresponding acoustic system is provided for this purpose.

In accordance with the invention, this object is achieved by a method for amplifying an acoustic signal, especially for a hearing aid, by receiving a limit gain frequency response curve of the amplification device which represents the limit for feedback whistling, and creating a target gain frequency response curve with a number of interpolation points in which for each interpolation point, the limit gain frequency response curve has a predetermined minimum distance in at least two directions in the gain frequency diagram. See FIG. 3.

In addition, the invention provides an acoustic system with an amplification device and a detection device for receiving a limit gain frequency response curve of the amplification device which represents the limit for feedback whistling as well as a processing unit to create a target gain frequency curve with a number of interpolation points, in which each interpolation has a minimum predetermined distance to the limit gain frequency response curve in at least two different directions in the gain frequency diagram and to feed the target gain frequency response curve into the amplification device. See FIG. 4.

In accordance with the present invention, the gain frequency response of the feedback path may not only change in the gain direction because of dynamic processes but can also tolerate shifts of resonances in the frequency direction.

Preferably the relevant minimum distance of the target gain frequency response curve is predetermined by the limit gain frequency response curve in the horizontal and vertical direction. This means that minimum distances in the gain direction and in the frequency direction are necessarily adhered to.

The distance between of the target gain frequency response curve and the limit gain frequency response curve can be determined, for at least a part of the frequency range using a circle, the center point of said circle being shifted along the target gain frequency response curve and the circle always touching the limit frequency response curve in this case. In this way the target gain frequency response curve can be easily calculated as a function of the limit gain frequency response curve while adhering to a minimum distance perpendicular to the target gain frequency response curve. In specific other subareas of the limit gain frequency response curve the target gain can be selected to be higher or lower in accordance with other criteria.

Alternatively the distance between the target gain frequency response curve and the limit gain frequency response curve can be determined, for at least a part of the frequency range with the aid of an ellipse of which the center point is shifted along the target gain frequency response curve and which always touches the limit gain frequency response curve. In this way, with the aid of an ellipse, it can be ensured that the minimum distance in the horizontal direction differs from the minimum distance and the vertical direction.

In addition the invention may provide for the distance between at the target gain frequency response curve and the limit gain frequency response curve to be set differently in at least two frequency ranges. This enables a more targeted reaction to the dynamic behavior of the acoustic system. In particular the minimum distance of the two frequency response curves can be kept smaller in frequency ranges which are little affected by dynamic changes.

The present invention will now be explained in greater detail with reference to the enclosed drawings.

The exemplary embodiment described in greater detail below represents a preferred embodiment of the present invention.

DETAILED DESCRIPTION OF INVENTION

Figure 1A:
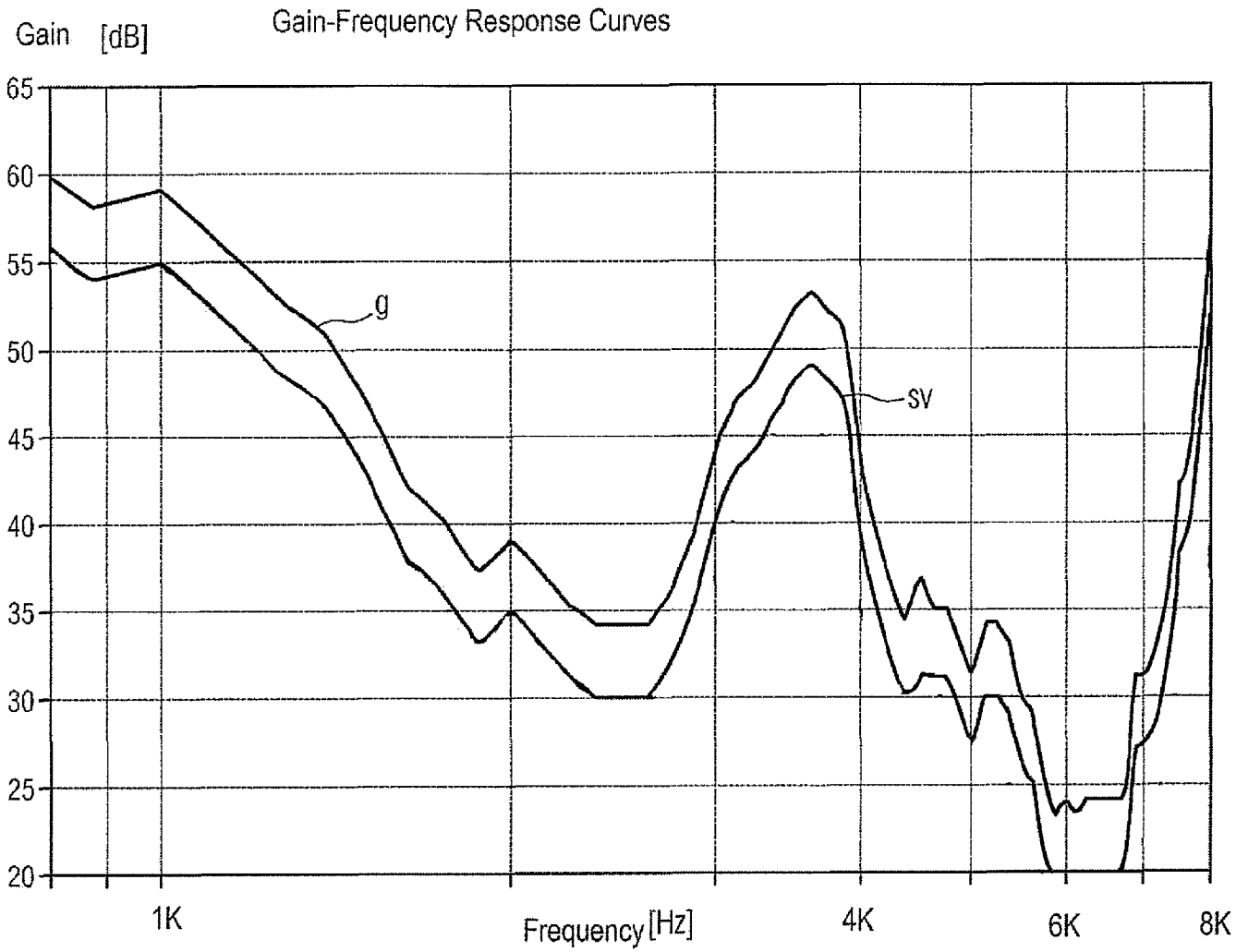
(PRIOR ART) FIG 1a
FIG. 1*a* illustrates a limit gain frequency response curve (g) and a corresponding "vertically shifted" gain frequency response curve (sv) in a gain frequency diagram of the prior art.
Figure 1B:
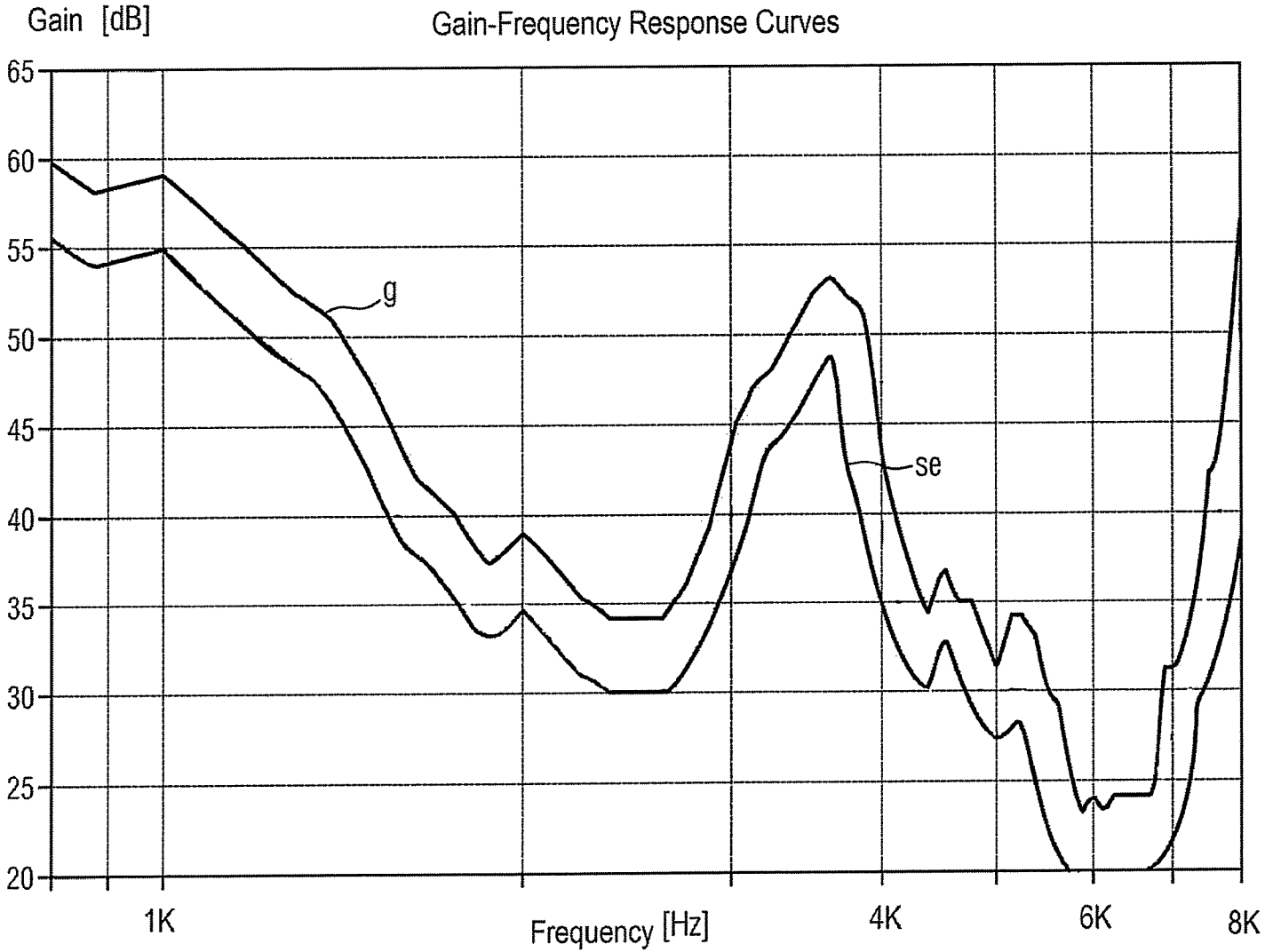
FIG. 1*b* illustrates a limit gain frequency response curve (g) and a corresponding target gain frequency response curve (se) of the present invention in a gain frequency diagram.

In accordance with the example selected here the target gain is adapted as a function of the limit gain frequency response curve such that a minimum distance is adhered to in two directions. This means that the target gain frequency curve must maintain a minimum distance not only vertically but also horizontally. To this end FIGS. 1*a* and 1*b* show a limit gain frequency response curve (g) measured for a hearing aid. In the 2.5 kHz and 6 kHz range lie resonances which are caused by the hearing aid when it is being used. In these areas the limit gain at which no attenuation occurs in the feedback circuit is thus comparatively small.

In order for the likelihood of the occurrence of feedback whistling to be reduced, in accordance with the prior art as shown in FIG. 1*a*, a "vertically shifted" gain frequency response curve (sv) can be determined, which in relation to the limit gain frequency response curve (g), is shifted vertically downwards, i.e. in the gain direction. In this case for example the gain it is reduced by 6 dB at each frequency.

It can easily be seen from the diagram that in steep areas of the frequency response curves (g) and (sv), the horizontal distance between the two curves can be very small. As a result, in the event of a shift in an actual limit gain frequency response curve, for example as a result of a change in the position of the hearing aid, the gain frequency response curve (sv) could lie above the actual limit gain frequency response curve in one or more spectral areas. As a result, a whistling can occur in the hearing-aid.

In accordance with the invention, the target gain frequency response curve is thus selectively further reduced so that the target gain frequency response curve (se) is produced as shown in FIG. 1*b*. This target gain frequency response curve (se) also maintains a minimum distance in the horizontal direction, i.e. in the frequency direction, to the limit gain frequency response curve (g).

Figure 2A:
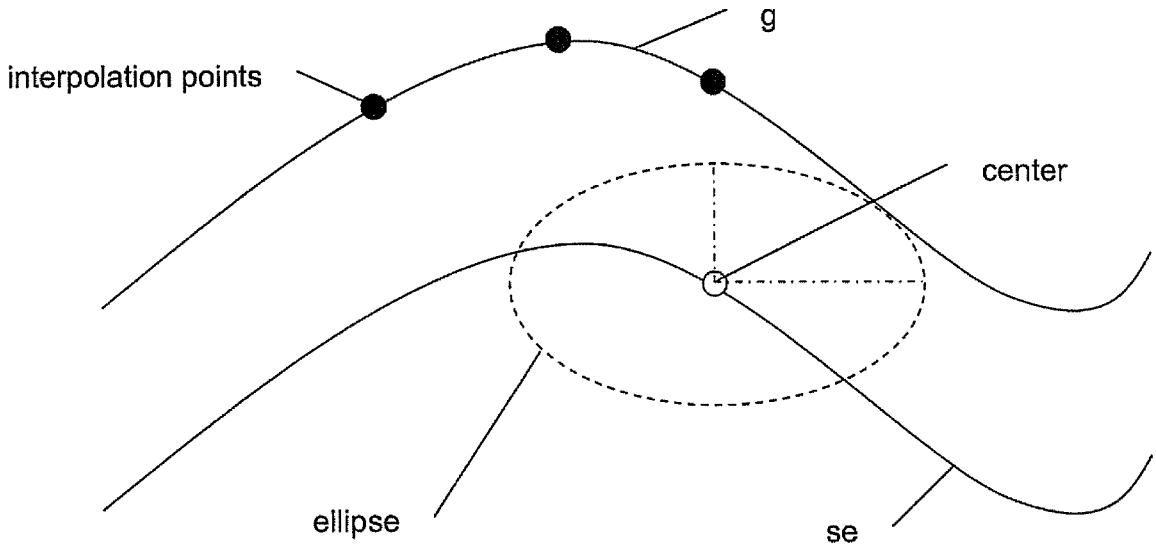
FIG. 2*a* illustrates the use of an ellipse to aid in the creation of the corresponding target gain frequency response curve (se) of the present invention.

As illustrated in FIG. 2*a*, the target gain frequency response curve (se) is determined with the aid of an ellipse of which the main axes define the vertical and horizontal distance. In addition the ellipse also defines the minimum distances in the angles deviating from the horizontal and vertical. In other words, when the ellipse is shifted with its center point along the target gain frequency response curve (se) it always only touches the limit gain frequency response curve (g) tangentially.

The same of course also applies if the ellipse is shifted above the measured limit gain frequency response curve (g). The target gain frequency response curve (se) then never intersects with the ellipse.

Figure 2B:
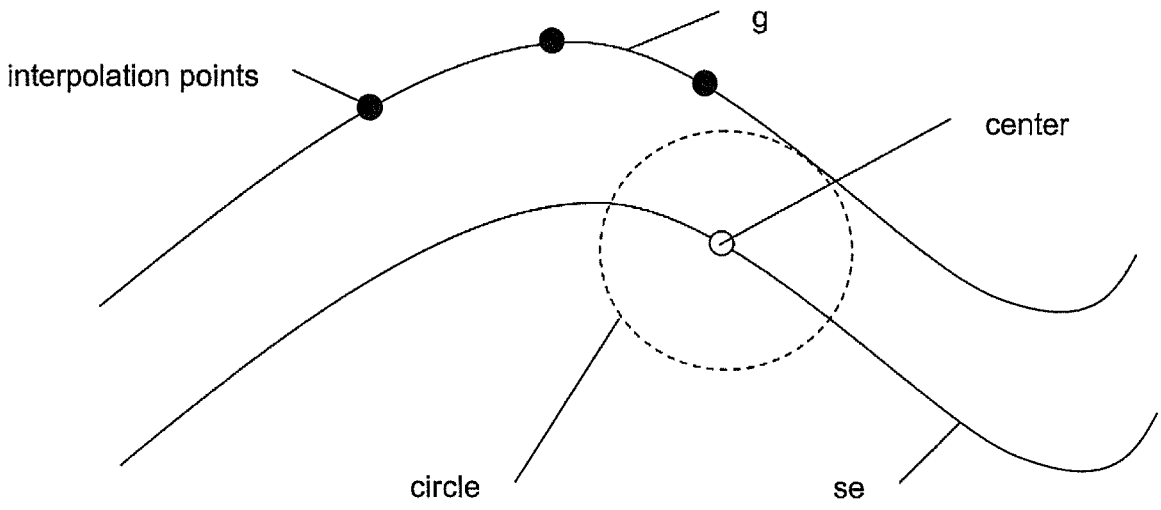
FIG. 2*b* illustrates the use of a circle to aid in the creation of the corresponding target gain frequency response curve (se) of the present invention.
Figure 3:
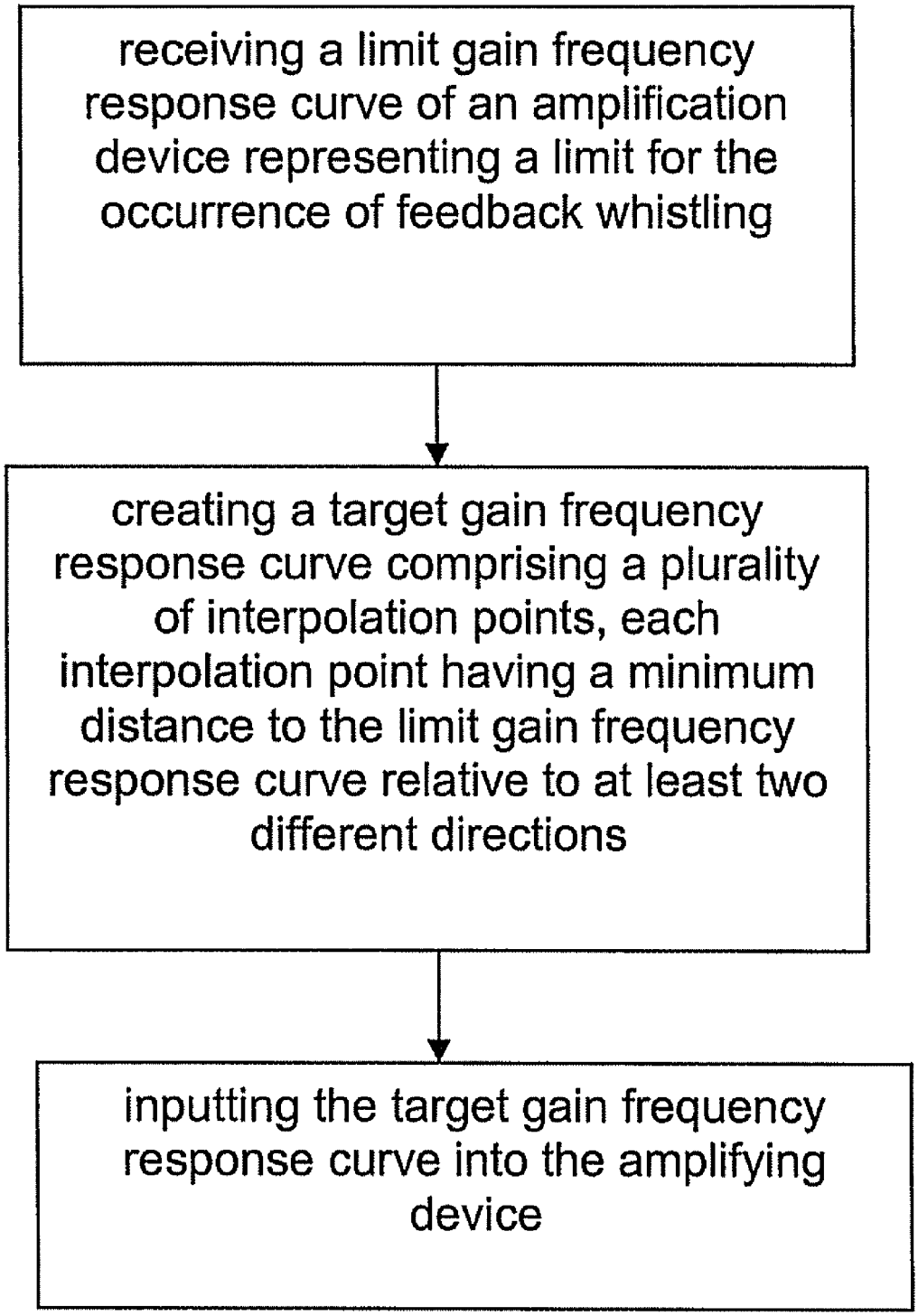
FIG. 3 illustrates a flowchart of the method of the present invention.
Figure 4:
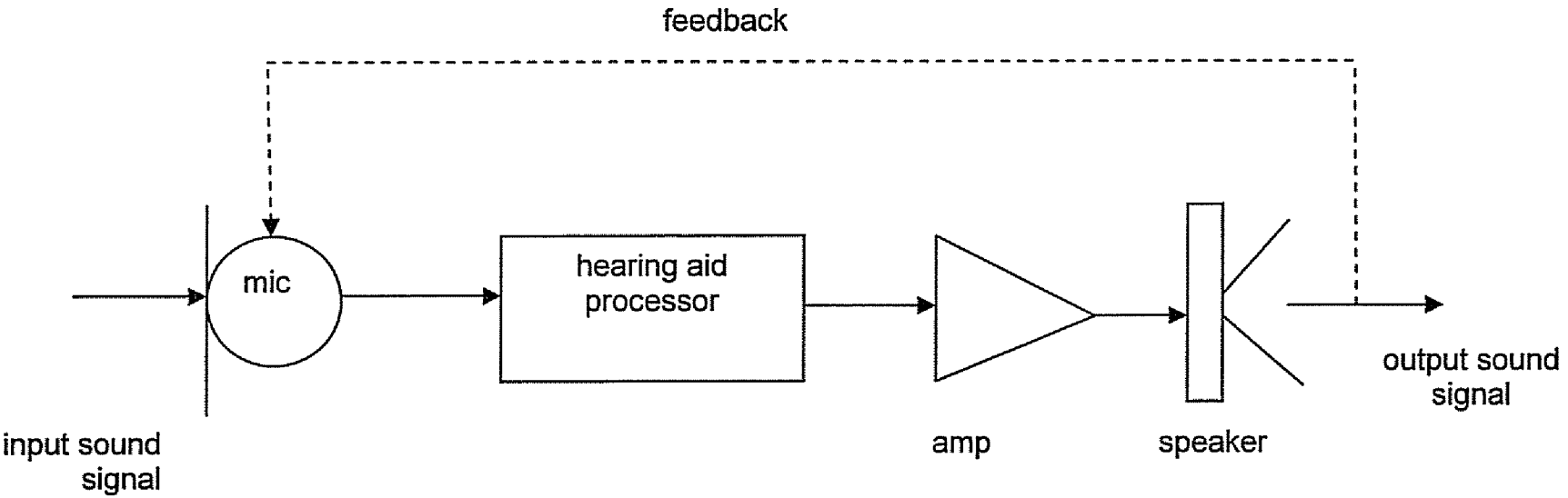
FIG. 4 illustrates a block diagram of the acoustic system of the present invention.

Instead of an ellipse, as illustrated in FIG. 2*b*, a circle or another geometric form or another function could be used to determine the target gain frequency response curve (se). A circle would for example ensure an orthogonal distance between the two curves (g) and (se).

In the example shown above, the minimum distance between the two frequency response curves (g) and (se) is determined over the entire frequency range in the same way. In accordance with an alternative embodiment the distance can be defined in one or more parts of the frequency range with different methods. For example in the lower frequency range, where resonances are hardly ever expected, the distance could be comparatively low and in the higher frequency range the distance could be selected to be correspondingly higher.

A significant advantage of the inventive choice of the target gain frequency response curve is that the vertical distance to the limit gain frequency response curve might not have to be so large since, in the case of a purely vertical spacing in accordance with the curve (sv) to achieve a sufficient horizontal distance, the vertical distance would have had to be significantly greater.

The invention claimed is:

1. A method of amplifying an acoustic signal for a hearing aid, wherein the hearing aid comprises a processing device for controlling an amplification based on a frequency gain characteristic for the hearing aid represented by a required gain curve relative to hearing loss, the method comprising:

determining a feedback gain limit by measuring gain in a feedback loop of the hearing aid that causes whistling and creating a limit gain frequency response curve representing a limit to the required gain curve for addressing the occurrence of feedback whistling;

creating by the processing device a target gain frequency response curve which is below the limit gain frequency response curve by shifting the limit gain frequency response curve based on a plurality of interpolation points, each interpolation point shifted a minimum distance with respect to the limit gain frequency response curve relative to at least two different directions, wherein the at least two different directions comprise a horizontal direction representing frequency and a vertical direction representing gain; and inputting by the processing device the target gain frequency response curve into the amplifying device to control the amplification in accordance with the target gain frequency response curve.

2. The method in accordance with claim 1, wherein a distance between the target gain frequency response curve and the limit gain frequency response curve in at least two different directions is determined relative to at least a part of a frequency range of the limit gain frequency response curve using an ellipse, with a center of the ellipse defining the target gain frequency response curve when the ellipse is shifted along the limit gain frequency response curve so that the ellipse always touches the limit gain frequency response curve at an outer contour of the ellipse.

3. The method in accordance with claim 1, wherein the target gain frequency response curve is determined relative to at least a part of a frequency range of the limit gain frequency response curve using an ellipse to offset the distance in at least two directions, with a center of the ellipse defining the target gain frequency response curve when the ellipse is shifted along the limit gain frequency response curve so that the ellipse always touches the limit gain frequency response curve at an outer contour of the ellipse.

4. The method in accordance with claim 1, wherein a distance between the target gain frequency response curve and the limit gain frequency response curve in at least two different directions is determined relative to at least a part of a frequency range of the limit gain frequency response curve using a circle, with a center of the circle defining the target gain frequency response curve when the circle is shifted along the limit gain frequency response curve so that the circle always touches the limit gain frequency response curve at an outer contour of the circle.

5. The method in accordance with claim 1, wherein the target gain frequency response curve is determined relative to at least a part of a frequency range of the limit gain frequency response curve using a circle to offset the distance in at least two directions, with a center of the circle defining the target gain frequency response curve when the circle is shifted along the limit gain frequency response curve so that the circle always touches the limit gain frequency response curve at an outer contour of the circle.

6. The method in accordance with claim 1, wherein the minimum distance between the target gain frequency response curve and the limit gain frequency response curve is different relative to at least two different frequency ranges.

7. An acoustic system for a hearing aid, comprising:

an amplification device;

a processing device for controlling the amplification device based on a frequency gain characteristic for the hearing aid represented by a required gain curve relative to hearing loss, the processing device configured to:

use a predetermined limit gain frequency response curve representing a limit to the required gain curve for addressing the occurrence of feedback whistling determined from a feedback gain limit by measuring gain in a feedback loop of the hearing aid that causes whistling;

determine a target gain frequency response curve comprising a plurality of interpolation points, each interpolation point having a minimum distance to the limit gain frequency response curve relative to at least two different direction, wherein the at least two different directions comprise a horizontal direction representing frequency and a vertical direction representing gain in a gain frequency diagram; and adjust the amplification device according to the target gain frequency response curve to control the amplification in accordance therewith.

8. The acoustic system in accordance with claim 7, wherein the processing device determines a distance between the target gain frequency response curve and the limit gain frequency response curve relative to at least a part of a frequency range of the limit gain frequency response curve using an ellipse to offset the distance in at least two directions, with a center of the ellipse defining the target gain frequency response curve when the ellipse is shifted along the limit gain frequency response curve so that the ellipse always touches the limit gain frequency response curve at an outer contour of the ellipse.

9. The acoustic system in accordance with claim 7, wherein the processing device determines the target gain frequency response curve relative to at least a part of a frequency range of the limit gain frequency response curve using an ellipse to offset the distance in at least two directions, with a center of the ellipse defining the target gain frequency response curve when the ellipse is shifted along the limit gain frequency response curve so that the ellipse always touches the limit gain frequency response at an outer contour of the ellipse.

10. The acoustic system in accordance with claim 7, wherein the processing device determines a distance between the target gain frequency response curve and the limit gain frequency response curve relative to at least a part of a frequency range of the limit gain frequency response curve using a circle to offset the distance in at least two directions, with a center of the circle defining the target gain frequency response curve when the circle is shifted along the limit gain frequency response curve so that the circle always touches the limit gain frequency response curve at an outer contour of the circle.

11. The acoustic system in accordance with claim 7, wherein the processing device determines the desired gain frequency response curve relative to at least a part of a frequency range of the limit gain frequency response curve using a circle to offset the distance in at least two directions, with a center of the circle defining the target gain frequency response curve when the circle is shifted along the limit gain frequency response curve so that the circle always touches the limit gain frequency response curve at an outer contour of the circle.

12. The acoustic system in accordance with claim 7, wherein the minimum distance between the target gain frequency response curve and the limit gain frequency response curve is set differently relative to at least two different frequency ranges.

* * * * *